US008147675B2

(12) United States Patent
Marchionna et al.

(10) Patent No.: US 8,147,675 B2
(45) Date of Patent: Apr. 3, 2012

(54) PROCESS FOR THE TOTAL CONVERSION OF HEAVY FEEDSTOCKS TO DISTILLATES

(75) Inventors: Mario Marchionna, Milan (IT); Salvatore Meli, Zelo Buon Persico (IT); Luigi Patron, Milan (IT); Alberto Delbianco, Robecco Sul Naviglio (IT); Nicoletta Panariti, Lecco (IT)

(73) Assignee: ENI S.p.A., Rome (IT)

( * ) Notice: Subject to any disclaimer, the term of this patent is extended or adjusted under 35 U.S.C. 154(b) by 422 days.

(21) Appl. No.: 12/375,610

(22) PCT Filed: Jul. 27, 2007

(86) PCT No.: PCT/EP2007/006708

§ 371 (c)(1),
(2), (4) Date: Apr. 27, 2009

(87) PCT Pub. No.: WO2008/014947

PCT Pub. Date: Feb. 7, 2008

(65) Prior Publication Data

US 2009/0261016 A1 Oct. 22, 2009

(30) Foreign Application Priority Data

Jul. 31, 2006 (IT) ..... M12006A1512

(51) Int. Cl.
*C10G 45/00* (2006.01)

(52) U.S. Cl. ..... 208/49; 208/57; 208/58

(58) Field of Classification Search ..... 208/49–77
See application file for complete search history.

(56) References Cited

U.S. PATENT DOCUMENTS

| | | | | |
|---|---|---|---|---|
| 3,905,892 | A | 9/1975 | Gregoli et al. | |
| 4,062,758 | A * | 12/1977 | Goudriaan et al. | 208/80 |
| 4,176,048 | A | 11/1979 | Corns et al. | |
| 5,013,427 | A * | 5/1991 | Mosby et al. | 208/211 |
| 5,932,090 | A | 8/1999 | Marchionna et al. | |
| 2003/0089636 | A1 | 5/2003 | Marchionna et al. | |
| 2006/0157385 | A1 | 7/2006 | Montanari et al. | |
| 2006/0163115 | A1 | 7/2006 | Montanari et al. | |
| 2006/0175229 | A1 | 8/2006 | Montanari et al. | |
| 2006/0186021 | A1 | 8/2006 | Marchionna et al. | |
| 2006/0272982 | A1 | 12/2006 | Montanari et al. | |
| 2007/0144944 | A1 | 6/2007 | Del Bianco et al. | |

FOREIGN PATENT DOCUMENTS

WO 2005 047425 5/2005

OTHER PUBLICATIONS

U.S. Appl. No. 12/375,615, filed Jan. 29, 2009, Marchionna, et al.
U.S. Appl. No. 12/248,163, filed Oct. 9, 2008, Marchionna, et al.
U.S. Appl. No. 12/725,915, filed Mar. 17, 201, Marchionna, et al.
U.S. Appl. No. 13/169,950, filed Jun. 27, 2011, Marchionna, et al.

* cited by examiner

*Primary Examiner* — Walter D Griffin
*Assistant Examiner* — Brian McCaig
(74) *Attorney, Agent, or Firm* — Oblon, Spivak, McClelland, Maier & Neustadt, L.L.P.

(57) ABSTRACT

A process for the conversion of heavy feedstocks selected from heavy crude oils, distillation residues from crude oil or coming from catalytic treatment, visbreaker tars, thermal tars, bitumens from oil sands, liquids from coats of different origins and other high-boiling feedstocks of a hydrocarbon nature known as "black oils."

29 Claims, 1 Drawing Sheet

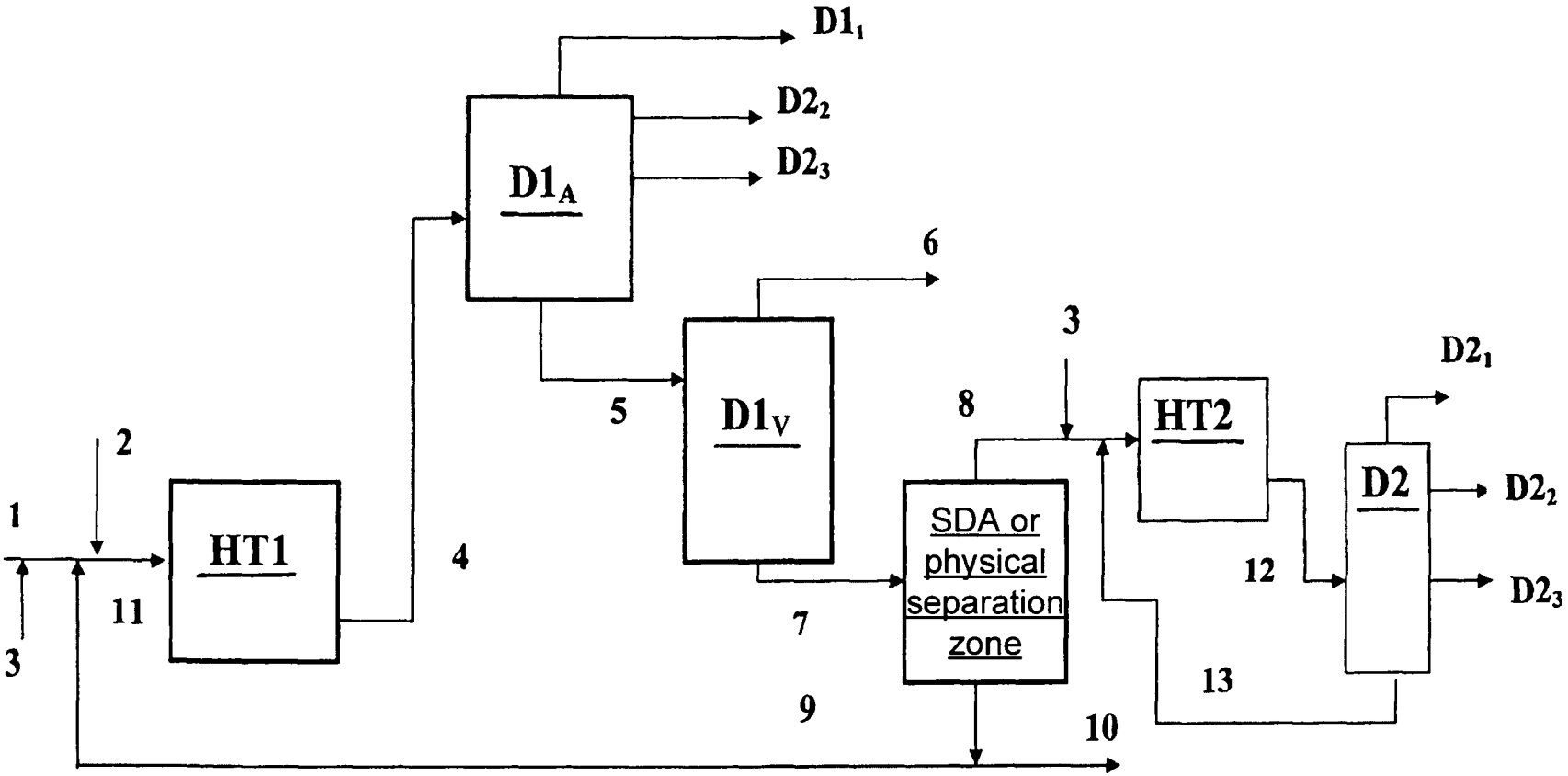
D1A
D1V
HT1
HT2
D2
SDA or physical separation zone
D1₁
D2₂
D2₃
D2₁
D2₂
D2₃
1
2
3
3
4
5
6
7
8
9
10
11
12
13

PROCESS FOR THE TOTAL CONVERSION OF HEAVY FEEDSTOCKS TO DISTILLATES

The present invention relates to a high productivity process for the total conversion to distillates only, without the contextual production of fuel oil or coke, of heavy feedstocks, among which heavy crude oils also with a high metal content, distillation residues, heavy oils coming from catalytic treatment, visbreaker tars, thermal tars, bitumens from oil sands possibly obtained from mining, liquids from coals of different origins and other high-boiling feedstocks of a hydrocarbon origin known as "black oils".

Fuel oil and coke are undesired by-products of conversion processes of heavy feedstocks due to the high level of pollutants accumulated therein, thus greatly limiting the possibility of their use or even obliging them to be sent for disposal (coke). The upgrading schemes currently applied comprise the production of fuel oil, coke or sidestreams destined for thermal use or to be gasified. Apart from the above economical and environmental reasons, these processes seem inadequate as a result of the unproductive yield to distillates when the highest possible volume of products is requested from each barrel of feedstock to be used.

The conversion of these heavy feedstocks into liquid products can be substantially effected in two ways: one thermally, and the other by means of hydrogenating treatment.

Current studies are mainly directed towards hydrogenating treatment, as thermal processes, still widely used, have intrinsic limits associated with the production of coke or heavy pitches with a consequent low yield to distillates.

Upgrading processes of residues by means of hydroconversion consist in treating the feedstock in the presence of hydrogen and suitable catalysts, following different objectives:

- Demolishing the high molecular weight asphaltenes structures and favouring the removal of Ni and V (hydrodemetallation, HDM) and contemporaneously reducing the content of asphaltenes in the feedstock.
- Removing S and N by means of hydrogenation and hydrogenolysis reactions (hydrodesulfuration, HDS and hydrodenitrogenation, HDN respectively).
- Reducing the CCR (Conradson Carbonaceous Residue) by means of Hydrocracking (HC) and hydrodearomatization (HDA) reactions.
- Transforming the high molecular weight molecules into light molecules (distillates) by means of Hydrocracking reactions (HC).

The hydroconversion technologies currently adopted use fixed or ebullated bed reactors and make use of catalysts generally consisting of one or more transition metals (Mo, W, Ni, Co, etc.) supported on silica/alumina, or other oxide carriers.

Fixed bed technologies, also in the most advanced versions, have great limitations:

- they cannot process feedstocks with Ni+V contents higher than 250 ppm as this would imply too frequent regeneration cycles of the catalyst;
- they cannot process heavy feedstocks as described above due the excessive formation of pitches on the catalyst;
- they do not allow the conversion of heavy feedstocks to degrees higher than 30-40%.

As a result of these limitations, fixed bed hydroconversion technologies are totally inadequate for configuring total conversion schemes of heavy feedstocks to distillates.

In order to partly overcome these limitations, ebullated bed processes were developed in which although the catalytic bed is confined within a certain area of the reactor, it is mobile and can expand as a result of the flow of reagents in liquid and gaseous phase. This allows the reactor to be equipped with mechanical apparatuses for removing the exhausted catalyst and feeding fresh catalyst in continuous without interrupting the running of the reactor. For this possibility of continuously substituting the exhausted catalyst, ebullated bed technologies can process heavy feedstocks with a metal content of up to 1,200 ppm Ni+V. Catalysts in a spheroidal form can in fact reach metal (Ni+V) uptake levels of up to 100% of their weight. Although the ebullated bed technology benefits from the improvements granted by the continuous regeneration of the catalyst, it only allows conversion levels to distillates up to a maximum of 60% to be obtained. It is possible to bring the conversion to 80% by operating under highly severe conditions and with the recycling of a quota of the products, with problems however of stability of the fuel oil produced due to the separation of the non-converted asphaltene phase which, also in this case, remains the core of the problem. For these reasons, even if the ebullated bed technology leads to a significant production of fuel oil, it is not suitable for total conversion processes to distillates.

As an alternative to hydroconversion processes based on the use of fixed bed or ebullated bed supported catalysts, processes have been proposed which use catalysts homogeneously dispersed in the reaction medium (slurry). These slurry processes are characterized by the presence of particles of catalyst having very small average dimensions and uniformly dispersed in the hydrocarbon phase.

It is consequently difficult for the activity of the catalyst to be influenced by the presence of metals or carbonaceous residues coming from the degradation of asphaltenes. This, together with the high efficiency of the catalyst defined, forms the premises for configuring, as described in patent application IT-95A001095, a conversion process of heavy feedstocks which allows their total trans-formation (zero residue refinery), comprising the asphaltene section, to distillates and hydrocarbon streams (deasphalted oils) of such a high quality that they can be fed to refinery catalytic cracking plants, such as Hydrocracking and Fluid Bed Catalytic Cracking (FCC).

Said patent application IT-95A001095, describes more specifically a process which allows the catalyst recovered to be recycled to the hydrotreatment reactor without the necessity of a further regeneration step. It is generally necessary to effect a flushing on the recycled stream to prevent the metallic sulfides produced as a result of the demetallation, from accumulating at such high levels as to hinder the efficiency of the process (hydrotreatment reactor, column bottom, separators, pumps and piping). The volumes of the flushing stream therefore depend on the level of metals in the feedstock and quantity of solids the recycled stream can tolerate and which, on the basis of our experience, can vary from 0.3-4% of the feedstock itself. The catalyst is obviously also fatally subtracted from the reaction cycle together with the flushing and must consequently be continuously reintegrated to an equivalent extent.

A desirable evolution of this process should aim at obtaining distillates alone for obvious economical reasons and for considerably simplifying the refining cycle, which is specifically what the present invention proposes, together with other objectives.

The definition of a conversion process which allows the total transformation of heavy feedstocks to distillates has so far remained unsolved. The main obstacle consists of the operability limits, mainly the formation of coke, which are encountered when, in order to complete the conversion of heavy oils to distillates, the conditions of the hydrogenation reactor, whether it be with or without a supported catalyst, become severe.

More specifically, the objectives at which an ideal process (at the moment not available) in the field of the treatment of residues should be aimed, are the following:

- maximizing the conversion without producing coke or fuel oil;
- maximizing the production of distillates;
- optimally managing the reactivity of the system (kinetics of conversion reactions to distillates and kinetics of reactions which lead to the formation of by-products) to minimize the reaction volumes and therefore reduce the investment costs, taking into account that said technologies applied for the upgrading of extra-heavy oils or bituminous sands, have to have considerable potentialities.

A process configuration has therefore been surprisingly found for the treatment of heavy feedstocks based on two steps wherein in the first step the heavy feedstock is effectively hydrotreated in a slurry reactor with a dispersed catalyst. The objective of this operation is to demolish the high molecular weight asphaltene structures to favour the removal of Ni and V (hydrodemetallation, HDM) and contemporaneously to reduce the content of asphaltenes in the feedstock converting part of it to distillates by means of rapid dealkylation processes.

At the outlet of the first hydrotreatment reactor, after separation of the gaseous effluents, the liquid effluent, containing the dispersed catalyst and Ni and V sulfides, is subjected to unitary separation operations (distillations and deasphaltations or possibly physical separations of the solids comprising the catalyst) in order to recover the products resulting from the HDM reaction and hydrotreatment reactions which accompany it (HDS, HDN, HDA and HC).

The residue containing the solids in dispersed phase (catalyst and Ni and V sulfides) is recycled to the first hydrotreatment reactor. In order to maintain a level of Ni and V sulfides compatible with the operability of the reaction cycle, an at least partial flushing is effected on said stream containing the solids, from which a quota of catalyst is inevitably subtracted, which must be integrated. This quota can be kept suitably low by operating with relatively low concentrations of catalyst.

The demetalled oily product obtained is then sent to a second step where it can be treated under high concentration conditions of catalyst and temperature to directly obtain end-products, at the same time limiting the undesired production of coke which impedes the recycling of the catalyst.

We have also found that the tendency towards the formation of coke depends on both the concentration of the hydrogenation catalyst based on a transition metal (with high concentrations of catalyst, the formation is practically suppressed within a wide temperature range, whereas it is evident under analogously severe conditions, when the catalyst is present in low concentrations), and also on the nature and quantity of maltenes with respect to the asphaltenes present in the system (an increase in the maltenes/asphaltenes ratio can in fact create a situation of instability which can lead to the precipitation of the asphaltenes and subsequently to the formation of coke).

As far as the first aspect is concerned, operating at high temperatures with high concentrations of catalyst allows high productivities to be reached with a good control on the formation of coke. In conventional processes, this is not possible as high concentrations of catalyst correspond, in relation to the flushing degree, to a high consumption which can jeopardize the economical aspect, in the present invention however this drawback is overcome as an efficient preventive demetallation is effected.

An important positive aspect of this approach, however, relates to the fact that high severity reactions (i.e. those that lead to the total transformation of the feedstock to distillates) are carried out in a system without a certain quantity of light paraffins and maltenes (i.e. the distillates of the first step) and they can therefore be run at relatively high temperatures without coming up against problems of instability of the asphaltenes.

To summarize, the specific characteristic of this approach is to envisage two hydrotreatment steps operating under different severity conditions:

- the first reactor can operate under sufficiently bland conditions to avoid the undesired formation of coke and favour the desired reactions (obtaining an efficient demetallation, a significant Hydrocracking of the alkyl side chains present on the heavy aromatic structures with the consequent production of distillates and a partial reduction in asphaltenes). The use of sufficiently reduced residence times allows high productivities to be reached;
- the second reactor, on the other hand, can operate under forced conditions (high temperatures and high concentration of catalyst), thus obtaining high productivities, as the hydrogenating capacity can be enhanced, now free of flushing aspects relating to the presence of other metals and coke, as well as of problems relating to instability of the asphaltenes.

By separating the various reactive functions in the best possible way, this approach allows, on the one hand, the direct production of semi-finished distillates required by the market with industrially acceptable reaction rates for a high capacity process and, on the other, the formation of coke to be avoided without the necessity of effecting a flushing (at least on the second hydrotreatment reactor), otherwise envisaged in the schemes so far known.

More specifically, the process, object of the present invention, for the conversion of heavy feedstocks selected from heavy crude oils, distillation residues from crude oil or coming from catalytic treatment, visbreaker tars, thermal tars, bitumens from oil sands, liquids from coals of different origins and other high-boiling feedstocks of a hydrocarbon origin, known as "black oils", comprises the following steps:

- mixing the heavy feedstock with a suitable hydrogenation catalyst and sending the mixture obtained to a first hydrotreatment area (HT1) to which hydrogen or a mixture of hydrogen and $H_2S$ are introduced;
- sending the effluent stream from the first hydrotreatment area (HT1), containing the hydrotreatment reaction product and the catalyst in dispersed phase, to a first distillation area (D1) having one or more flash steps and/or atmospheric distillation and/or vacuum distillation whereby the various fractions coming from the hydrotreatment reaction are separated;
- sending at least part of the distillation residue (tar) or liquid leaving the flash unit of the first distillation area (D1), containing the catalyst in dispersed phase, rich in metallic sulfides produced by demetallation of the feedstock and optionally minimum quantities of coke, to a deasphalting area (SDA) in the presence of solvents or to a physical separation zone, obtaining, in the case of the deasphalting area, two streams, one consisting of deasphalted oil (DAO), the other containing asphaltenes at least partially recycled to the first hydrotreatment area, in the case of the physical separation area, the solids separated and a liquid stream;

sending the stream consisting of deasphalted oil (DAO) or the liquid stream separated in the physical separation area, to a second hydrotreatment area (HT2), to which hydrogen or a mixture of hydrogen and $H_2S$ and a suitable hydrogenation catalyst are introduced;

sending the effluent stream from the second hydrotreatment area (HT2), containing the hydrotreatment reaction product and the catalyst in dispersed phase, to a second distillation area (D2) having one or more flash and/or distillation steps whereby the various fractions coming from the second hydrotreatment area are separated;

recycling at least part of the distillation residue or liquid leaving the flash unit of the second distillation area (D2), containing the catalyst in dispersed phase to the second hydrotreatment area (HT2).

In the case of the use of a deasphalting area, the stream containing asphaltenes obtained in the deasphalting step (SDA), which contains the catalyst in dispersed phase and is enriched in metals coming from the initial feedstock, but is substantially free of coke, is recycled to the first hydrotreatment area (HT1) preferably in a quantity of at least 80%, more preferably at least 95%.

In the case of the use of a physical separation area:

the separation of the solids can be facilitated by the addition of suitable solvents;

the stream containing the separated solids can be recycled to the first hydrotreatment area (HT1) preferably in a quantity of at least 80%, more preferably at least 95%.

The first distillation area (D1) preferably consists of an atmospheric distillation column and a vacuum distillation column, fed by the bottom fraction of said atmospheric distillation column. One or more flash steps can be optionally added before said atmospheric distillation column.

Two streams are obtained from the vacuum distillation column, a bottom stream consisting of the distillation residue, the other essentially consisting of vacuum gas oil (VGO) which can be optionally sent, at least partially, to the second hydrotreatment area (HT2).

The second distillation area (D2) preferably consists of one or more flash steps and an atmospheric distillation column, even if in some cases the presence of an additional column operating under vacuum can be envisaged.

Substantially all the distillation residue (tar) is preferably recycled to the second hydrotreatment area (HT2).

The heavy feedstocks treated can be of a varying nature: they can be selected from heavy crude oils, distillation residues, heavy oils coming from catalytic treatment, such as for example heavy cycle oils from catalytic cracking treatment, residue products from fixed bed and/or ebullated bed hydroconversion treatment, thermal tars (coming for example from visbreaking or similar thermal processes), bitumens from oils sands, liquids from coals of different origins and other high-boiling feedstocks of a hydrocarbon origin known as "black oils".

The catalysts used can be selected from those obtained from in-situ decomposable precursors (various kinds of metallic carboxylates such as naphthenates, octoates, etc., metallic derivatives of phosphonic acids, metallocarbonyls, heteropolyacids, etc.) or from preformed compounds based on one or more transition metals such as Ni, Co, Ru, W and Mo: the latter is preferred thanks to its high catalytic activity.

The concentration of transition metal contained in the catalyst fed to the first hydrotreatment area ranges from 50 to 20,000 ppm, preferably from 200 to 3,000 ppm.

The concentration of transition metal contained in the catalyst fed to the second hydrotreatment area ranges from 1,000 to 30,000 ppm, preferably from 3,000 to 20,000 ppm.

The first hydrotreatment area can consist of one or more reactors: part of the distillates produced in the first reactor can be sent to the subsequent reactors.

Said first hydrotreatment area preferably operates at a temperature ranging from 360 to 480° C., more preferably from 380 to 440° C., at a pressure ranging from 3 to 30 MPa, more preferably from 10 to 20 MPa, and with a residence time varying from 0.1 to 5 h, preferably from 0.5 to 3.5 h.

The second hydrotreatment area can consist of one or more reactors: part of the distillates produced in the first reactor of said area can be sent to the subsequent reactors of said area.

Said second hydrotreatment area preferably operates at a temperature ranging from 400 to 480° C., more preferably from 420 to 460° C., at a pressure ranging from 3 to 30 MPa, more preferably from 10 to 20 MPa, and with a residence time varying from 0.5 to 6 h, preferably from 1 to 4 h.

Hydrogen is fed to the reactor, which can operate in both a down-flow mode and, preferably, up-flow. Said gas can be fed to several sections of the reactor.

The vacuum section of the first distillation area preferably operates at a reduced pressure ranging from 0.005 to 1 atm, more preferably from 0.015 to 0.1 atm.

The vacuum section, when present, of the second distillation area preferably operates at reduced pressure ranging from 0.005 to 1 atm, more preferably from 0.015 to 0.1 atm.

The deasphalting step, effected by means of an extraction with solvent, either hydrocarbon or non-hydrocarbon, preferably with paraffins or iso-paraffins having from 3 to 6, preferably from 4 to 5, carbon atoms, is normally carried out at temperatures ranging from 40 to 230° C. and a pressure of 0.1 to 7 MPa. It can also consist of one or more sections operating with the same solvent or different solvents; the recovery of the solvent can be effected under sub-critical or super-critical conditions with one or more steps, thus allowing a further fractionation between the deasphalted oil (DAO) and resins.

By incorporating the process described in patent application IT-MI2003A-000692 in the present patent application, a further secondary section can be optionally present for the hydrogenation post-treatment of the $C_2$-500° C. fraction, preferably the $C_5$-350° C. fraction, coming from the section of high pressure separators envisaged upstream of the first and second distillation area and downstream of the hydrotreatment section (HT1) and hydrotreatment section (HT2).

The fixed bed hydrotreatment section of the light fractions obtained from the separation pre-steps effected at a high pressure on the hydrotreatment reaction products (HT1 and HT2) can be shared.

In addition to the possible secondary hydrogenating post-treatment section there can optionally be a further secondary post-treatment section of the flushing stream, by incorporating the process described in IT-MI2003A-000693 in the present patent application.

A preferred embodiment of the present invention is now provided with the help of FIG. 1 enclosed which however should not be considered as limiting the scope of the invention itself.

The heavy feedstock (1) is mixed with fresh catalyst (2) and sent to the first hydrotreatment area (HT1) consisting of one or more reactors in series and/or in parallel into which hydrogen or a mixture of hydrogen/$H_2S$ (3) is charged. A stream (4), containing the reaction product and catalyst in dispersed phase, leaves the reaction section HT1 and is sent to a first distillation area (D1) consisting of an atmospheric distillation column ($D1_A$) and a vacuum distillation column ($D1_V$).

The lighter fractions ($D1_1$, $D1_2$, $D1_3$, . . . , $D1_n$) are separated at the atmospheric distillation column ($D1_A$) from the heavier bottom fraction (5) which is fed to the vacuum distillation column ($D1_V$) separating two streams, one essentially consisting of vacuum gas oil (6), the other (7) a bottom residue which consists of the distillation residue of the first distillation area which is sent to the deasphalting unit (SDA), an operation which is effected by extraction with a solvent.

Two streams are obtained from the deasphalting unit: one consisting of DAO (8), the other containing asphaltenes (9).

The stream containing asphaltenes (9), except for a flushing (10), is mixed with fresh make-up catalyst (2) necessary for reintegrating that lost with the flushing stream (10), with the heavy feedstock (1) forming the stream (11) which is fed to the hydrotreatment reactor (HT1) of the first hydrotreatment area.

The stream consisting of DAO (8) is sent to a second hydrotreatment area (HT2), consisting of a hydrotreatment reactor in which hydrogen or a mixture of hydrogen/$H_2S$ (3) is charged. A stream (12) leaves said reactor (HT2), containing the reaction product and catalyst in dispersed phase, which is sent to a second distillation area (D2) consisting of an atmospheric distillation column in order to separate the lighter fractions ($D2_1$, $D2_2$, $D2_3$, . . . , $D2_n$) from the heavier bottom fraction (13) which is recycled to the second hydrotreatment area (HT2).

In an alternative configuration, the deasphalting section can be substituted by a physical separation section of the catalyst and solids (decanting, filtration . . . ) wherein the separation of the solids from the liquids can be optionally facilitated by the addition of suitable diluents (generally distillates). In this case, the solids separated can be partly recycled to the hydrogenation reactor HT1 or partly sent for disposal, whereas the liquid stream, provided it has been completely demetalled, is sent to the hydrotreatment section HT2.

Some examples are provided hereunder for a better illustration of the invention, which should in no way be considered as being limited thereto or thereby.

EXAMPLE 1

Following the scheme represented in FIG. 1, with reference to the HT1 treatment, the following experimentation was effected.

The catalytic tests were carried out using a 30 $cm^3$ stirred micro-autoclave according to the following general operating procedure:

approximately 10 g of the feedstock and molybdenum-based catalyst precursor are charged into the reactor;

the system is then pressurized with hydrogen and brought to the desired temperature by means of an electrically heated oven (total pressure under the reaction conditions: 16 MPa);

during the reaction the system is kept under stirring by means of a swinging capillary system operating at a rotation rate of 900 rpm; the total pressure is kept constant by means of an automatic reintegrating system of the hydrogen consumed;

at the end of the test, the quenching of the reaction is effected; the autoclave is then depressurised and the gases collected in a sampling bag; the gaseous samples are subsequently sent for gas chromatographic analysis;

the reaction product is recovered and filtered to separate the catalyst. The liquid fraction is analyzed for the determination of the yields and quality of the products.

The tests were carried out using the feedstock indicated in Table 1.

TABLE 1

| Characteristics of vacuum residue | | | | | | | | |
|---|---|---|---|---|---|---|---|---|
| Feedstock | CCR (w %) | $d^{20}$ (g/$cm^3$) | C (w %) | H (w %) | N (w %) | S (w %) | V (ppm) | Ni (ppm) |
| Vacuum residue | 18.9 | 1.0043 | 84.82 | 10.56 | 0.69 | 2.60 | 262 | 80 |

Table 2 indicates the reaction conditions and distributions of products obtained.

TABLE 2

| operating conditions, yields and product quality | | | | | |
|---|---|---|---|---|---|
| Temperature (° C.) | 430 | 430 | 430 | 430 | 415 |
| Mo (ppm) | 200 | 500 | 1000 | 3000 | 3000 |
| Reaction time (h) | 1 | 1 | 1 | 1 | 3 |
| Composition of products (w %) | | | | | |
| $H_2S$ | 0.7 | 0.6 | 0.6 | 0.9 | 0.8 |
| $C_1$-$C_4$ | 2.3 | 1.8 | 1.9 | 1.9 | 2.0 |
| IBP-160° C. | 2.4 | 3.0 | 2.6 | 2.4 | 1.9 |
| 160-220° C. | 8.0 | 3.9 | 3.6 | 3.7 | 8.6 |
| 220-365° C. | 17.7 | 15.8 | 15.6 | 14.5 | 16.3 |
| 365-500° C.+ | 19.3 | 20.4 | 20.4 | 22.0 | 19.5 |
| DAO $C_5$ 500° C.+ | 36.8 | 43.5 | 44.8 | 44.8 | 41.5 |
| ASF $C_5$ | 12.0 | 10.3 | 9.9 | 8.3 | 7.3 |
| Metals + insoluble residues | 0.8 | 0.4 | 0.7 | 1.6 | 2.1 |
| RCC (in DAO $C_5$ 500+) | 16.3 | 14.0 | 13.8 | 13.1 | 15.1 |
| S (w %) (distillates + DAO 500° C.$^+$) | 2.39 | 2.01 | 1.95 | 1.62 | 1.80 |
| Mo (ppm) | <1.0 | <1.0 | <1.0 | <1.0 | <1.0 |
| Ni (ppm) | 29.3 | 7.8 | 3.8 | 3.2 | 3.5 |
| V (ppm) | 39.3 | 9.0 | 5.9 | 3.2 | 1.6 |

EXAMPLE 2

Following the scheme represented in FIG. 1 with reference to the HT1, Distillation 1 and SDA treatment, the following experimentation was effected.

Hydrotreatment Step 1

Reactor: 3,500 cc steel equipped with magnetic stirring

Catalyst: 6,000 ppm of Mo/feedstock added using an oil-soluble organometallic precursor containing 15% w of metal Temperature: 420° C.

Pressure: 16 MPa of hydrogen

Reaction time: 3 h

The properties of the feedstock are those indicated in Table 1 of Example 1. A test was carried out according to the procedure described below. The reactor was charged with the residue and molybdenum compound and pressurized with hydrogen. The reaction was carried out under the operating conditions indicated. When the test was completed, quenching was effected; the autoclave was depressurised and the gases collected in a sampling bag for gas chromatographic analysis.

The liquid product present in the reactor was subjected to distillation and to subsequent deasphalting with different solvents.

Distillation Step

This was effected using laboratory equipment for distilling oil feedstocks.

Deasphalting Step (SDA)

Feedstock: residue produced from the hydrogenation reaction

Deasphalting agents: propane, n-butane, n-pentane

Temperature: from 80 to 180° C.

The product to be deasphalted and a volume of solvent equal to 8-10 times the residue volume are charged into an autoclave. The feedstock and solvent mixture is heated to a temperature of 80-180° C. and subjected to stirring (800 rpm) by means of a mechanical stirrer for a period of 30 minutes. At the end of the operation decanting is effected and the separation of the two phases, the asphaltene phase which is deposited on the bottom of the autoclave, and the deasphalted oil phase diluted in the solvent. The decanting lasts about two hours. The DAO-solvent phase is transferred, by means of a suitable recovery system, to a second tank. The DAO-solvent phase is then recovered, and the solvent is subsequently eliminated by evaporation.

Results of the Experimentation

Following the procedure described above, the results indicated in Table 3 were obtained.

TABLE 3 yields and product quality

| | Deasphalting solvent | | |
|---|---|---|---|
| | $C_3$ | n-$C_4$ | n-$C_5$ |
| IBP-160° C. (w %) | 3.5 | 3.8 | 3.8 |
| 160-220° C. (w %) | 7.5 | 6.4 | 6.5 |
| 220-365° C. (w %) | 28.1 | 21 | 23 |
| 365-500° C.+ (w %) | 60.9 | 68.8 | 66.7 |
| DAO yield | 74.2 | 86.2 | 93.5 |
| | DAO properties | | |
| C (w %) | 85.7 | 85.1 | 86.6 |
| H (w %) | 12.3 | 11.7 | 11.7 |
| N (w %) | 0.30 | 0.49 | 0.49 |
| S (w %) | 0.86 | 1.00 | 1.09 |
| RCC (w %) | 1.32 | 5.07 | 6.87 |
| Ni (ppm) | <0.5 | 1.2 | 1.2 |
| V (ppm) | <0.5 | <0.5 | <0.5 |
| Mo (ppm) | <0.5 | <0.5 | <0.5 |

EXAMPLE 3

Following the scheme represented in FIG. 1, with reference to the HT2 reaction step, the following experimentation was effected.

Hydrotreatment Step 2

The catalytic tests were carried out using a 30 $cm^3$ stirred microautoclave according to the following general operating procedure:

approximately 10 g of the feedstock and molybdenum-based catalyst precursor are charged into the reactor;

the system is then pressurized with hydrogen and brought to the desired temperature by means of an electrically heated oven;

during the reaction the system is kept under stirring by means of a swinging capillary system operating at a rotation rate of 900 rpm; the total pressure is kept constant by means of an automatic reintegrating system of the hydrogen consumed;

at the end of the test, the quenching of the reaction is effected; the autoclave is then depressurised and the gases collected in a sampling bag; the gaseous samples are subsequently sent for gas chromatographic analysis;

the reaction product is recovered and filtered to separate the catalyst. The liquid fraction is analyzed for the determination of the yields and quality of the products.

The feedstock used for the test was prepared from Example 2, and specifically from the DAO obtained by the deasphalting with n-butane of the residue produced by the hydrogenation reaction in the presence of dispersed catalyst.

Table 4 indicates the distribution data of the products and content of sulfur and carbonaceous residue contained in the mixture of products obtained.

TABLE 4 distribution of the reaction products obtained from DAO from n-butane according to Example 2.

| Temperature (° C.) | 420 | 430 | 430 | 430 | 440 |
|---|---|---|---|---|---|
| Mo (ppm) | 9000 | 9000 | 9000 | 9000 | 9000 |
| Reaction time (h) | 2.5 | 1.0 | 2.5 | 4.0 | 2.5 |
| | Composition of products (w %) | | | | |
| $C_1$-$C_4$ | 1.1 | 0.9 | 2.1 | 2.6 | 2.4 |
| IBP-160° C. | 0.1 | 0.1 | 2.0 | 1.8 | 2.5 |
| 160-220° C. | 2.1 | 2.3 | 4.6 | 6.2 | 7.2 |
| 220-365° C. | 11.5 | 11.6 | 18.5 | 23.1 | 25.5 |
| 365-500° C.+ | 34.7 | 33.4 | 34.3 | 34.5 | 35.5 |
| Residue 500° C.+ | 48.5 | 49.5 | 36.0 | 28.8 | 25.1 |
| Metals + insoluble residues | 2.0 | 2.2 | 2.5 | 3.0 | 1.8 |
| | Quality of products | | | | |
| RCC (w %) (Residue 500° C.+) | 12.90 | 17.40 | 12.44 | 9.98 | 10.96 |
| S (w %) (distillates + residue 500° C.+) | 0.44 | 0.49 | 0.52 | 0.57 | 0.62 |

The invention claimed is:

1. A process for the conversion of heavy feedstocks selected from heavy crude oils, distillation residues from crude oil or coming from catalytic treatment, visbreaker tars, thermal tars, bitumens from oil sands, liquids from coals of different origins and other high-boiling feedstocks of a hydrocarbon nature known as "black oils", comprising the following steps:

mixing the heavy feedstock with a suitable hydrogenation catalyst and sending the mixture obtained to a first hydrotreatment area (HT1) to which hydrogen or a mixture of hydrogen and $H_2S$ are introduced;

sending the effluent stream from the first hydrotreatment area (HT1), containing the hydrotreatment reaction product and the catalyst in dispersed phase, to a first distillation area (D1) having one or more flash steps and/or atmospheric distillation and/or vacuum distillation whereby the various fractions coming from the hydrotreatment reaction are separated;

sending at least part of the distillation residue (tar) or liquid leaving the flash unit of the first distillation area (D1), containing the catalyst in dispersed phase, rich in metallic sulfides produced by demetallation of the feedstock and optionally minimum quantities of coke, to a deasphalting area (SDA) in the presence of solvents or to a physical separation zone, obtaining, in the case of the deasphalting area, two streams, one consisting of deasphalted oil (DAO), the other containing asphaltenes at least partially recycled to the first hydrotreatment area, in the case of the physical separation area, the solids separated and a liquid stream;

sending the stream consisting of deasphalted oil (DAO) or the liquid stream separated in the physical separation area, to a second hydrotreatment area (HT2), to which hydrogen or a mixture of hydrogen and $H_2S$ and a suitable hydrogenation catalyst are introduced;

sending the effluent stream from the second hydrotreatment area (HT2), containing the hydrotreatment reaction product and the catalyst in dispersed phase, to a second distillation area (D2) having one or more flash and/or distillation steps whereby the various fractions coming from the second hydrotreatment area are separated;

recycling at least part of the distillation residue or liquid leaving the flash unit of the second distillation area (D2), containing the catalyst in dispersed phase to the second hydrotreatment area (HT2).

2. The process according to claim 1, wherein the first distillation area (D1) consists of an atmospheric distillation column and a vacuum distillation column, fed by the bottom fraction of said atmospheric distillation column.

3. The process according to claim 2, wherein two streams are obtained from the vacuum distillation column, a bottom stream consisting of the distillation residue of the first distillation area, the other essentially consisting of vacuum gas oil (VGO).

4. The process according to claim 3, wherein at least part of the stream essentially consisting of vacuum gas oil (VGO) is sent to the second hydrotreatment area (HT2).

5. The process according to claim 1, wherein at least 80% of the stream containing asphaltenes, which also contains catalyst in dispersed phase and is enriched with metals coming from the initial feedstock, is recycled to the first hydrotreatment area (HT1).

6. The process according to claim 5, wherein at least 95% of the stream containing asphaltenes is recycled to the first hydrotreatment area (HT1).

7. The process according to claim 1, wherein the separation of the solids in the physical separation area is facilitated by the addition of suitable diluents.

8. The process according to claim 1, wherein at least 80% of the stream containing the solids separated is recycled to the first hydrotreatment area (HT1).

9. The process according to claim 8, wherein at least 95% of the stream containing the solids separated is recycled to the first hydrotreatment area (HT1).

10. The process according to claim 1, wherein the second distillation area (D2) consists of one or more flash steps and an atmospheric distillation column.

11. The process according to claim 1, wherein substantially all the distillation residue (tar) or liquid leaving the flash unit of the second distillation area (D2) is recycled to the second hydrotreatment area (HT2).

12. The process according to claim 1, wherein the vacuum section of the first distillation area operates at a reduced pressure of 0.005 to 1 atm.

13. The process according to claim 12, wherein the vacuum section of the first distillation area operates at a reduced pressure of 0.015 to 0.1 atm.

14. The process according to claim 1, wherein the vacuum section of the second distillation area operates at a reduced pressure of 0.005 to 1 atm.

15. The process according to claim 14, wherein the vacuum section of the second distillation area operates at a reduced pressure of 0.015 to 0.1 atm.

16. The process according to claim 1, wherein the first hydrotreatment step (HT1) is carried out at a temperature ranging from 360 to 480° C. and a pressure ranging from 3 to 30 MPa.

17. The process according to claim 16, wherein the first hydrotreatment step (HT1) is carried out at a temperature ranging from 380 to 440° C. and a pressure ranging from 10 to 20 MPa.

18. The process according to claim 1, wherein the second hydrotreatment step (HT2) is carried out at a temperature ranging from 400 to 480° C. and a pressure ranging from 3 to 30 MPa.

19. The process according to claim 18, wherein the second hydrotreatment step (HT2) is carried out at a temperature ranging from 420 to 460° C. and a pressure ranging from 10 to 20 MPa.

20. The process according to claim 1, wherein the deasphalting step is carried out at temperatures ranging from 40 to 200° C. and a pressure ranging from 0.1 to 7 MPa.

21. The process according to claim 1, wherein the deasphalting solvent is a light paraffin with from 3 to 6 carbon atoms.

22. The process according to claim 21, wherein the deasphalting solvent is a light paraffin with from 4 to 5 carbon atoms.

23. The process according to claim 1, wherein the deasphalting step is carried out under subcritical or supercritical conditions with one or more steps.

24. The process according to claim 1, wherein the hydrogenation catalyst is a decomposable precursor or a preformed compound based on one or more transition metals, wherein the hydrogenation catalyst is used both in the first hydrotreating area (HT1) and in the second hydrotreating area (HT2).

25. The process according to claim 24, wherein the transition metal is molybdenum.

26. The process according to claim 1, wherein the concentration of the transition metal contained in the catalyst fed to the first hydrotreatment area, ranges from 50 to 20,000 ppm.

27. The process according to claim 26, wherein the concentration of the transition metal contained in the catalyst fed to the first hydrotreatment area, ranges from 200 to 3,000 ppm.

28. The process according to claim 1, wherein the concentration of the transition metal contained in the catalyst fed to the second hydrotreatment area ranges from 1,000 to 30,000 ppm.

29. The process according to claim 28, wherein the concentration of the transition metal contained in the catalyst fed to the second hydrotreatment area ranges from 3,000 to 20,000 ppm.

* * * * *